US009113531B2

(12) United States Patent
Tien et al.

(10) Patent No.: US 9,113,531 B2
(45) Date of Patent: Aug. 18, 2015

(54) METHOD FOR MIXING LIGHT OF LED CLUSTER

(75) Inventors: Chung-Hao Tien, Hsinchu (TW); Ming-Chin Chien, Hsinchu (TW); Song-Bor Chiang, Hsinchu (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 629 days.

(21) Appl. No.: 13/486,218

(22) Filed: Jun. 1, 2012

(65) Prior Publication Data

US 2013/0082622 A1 Apr. 4, 2013

(30) Foreign Application Priority Data

Sep. 29, 2011 (TW) ..... 100135174 A

(51) Int. Cl.
*H05B 33/08* (2006.01)

(52) U.S. Cl.
CPC ..... *H05B 33/086* (2013.01)

(58) Field of Classification Search
USPC ..... 315/291–311
See application file for complete search history.

(56) References Cited

U.S. PATENT DOCUMENTS

| | | | | |
|---|---|---|---|---|
| 6,717,376 | B2 * | 4/2004 | Lys et al. | 315/292 |
| 2010/0052575 | A1 * | 3/2010 | Feng et al. | 315/308 |
| 2012/0299476 | A1 * | 11/2012 | Roberts et al. | 315/77 |

OTHER PUBLICATIONS

Ming-Chin Chien and Chung-Hao Tien; Cluster LEDs mixing optimization by lens design techniques; Jun. 9, 2011; Publish: Optics Express.

* cited by examiner

*Primary Examiner* — Brandon S Cole
(74) *Attorney, Agent, or Firm* — Bacon & Thomas, PLLC

(57) ABSTRACT

The method for mixing light of LED cluster is disclosed. Firstly, a plurality of LED cluster are provided, then the step is importing the related data, then the step for the continuous genetic algorithm and the merit function are respectively carried out, finally the step for exporting data is achieved. The applied field of the invention is able to comprise LED cluster, fluorescence light source array, and fluorescence lamp array, as well as the other light source field etc.

2 Claims, 3 Drawing Sheets

Figure 3(a) Figure 3(c)
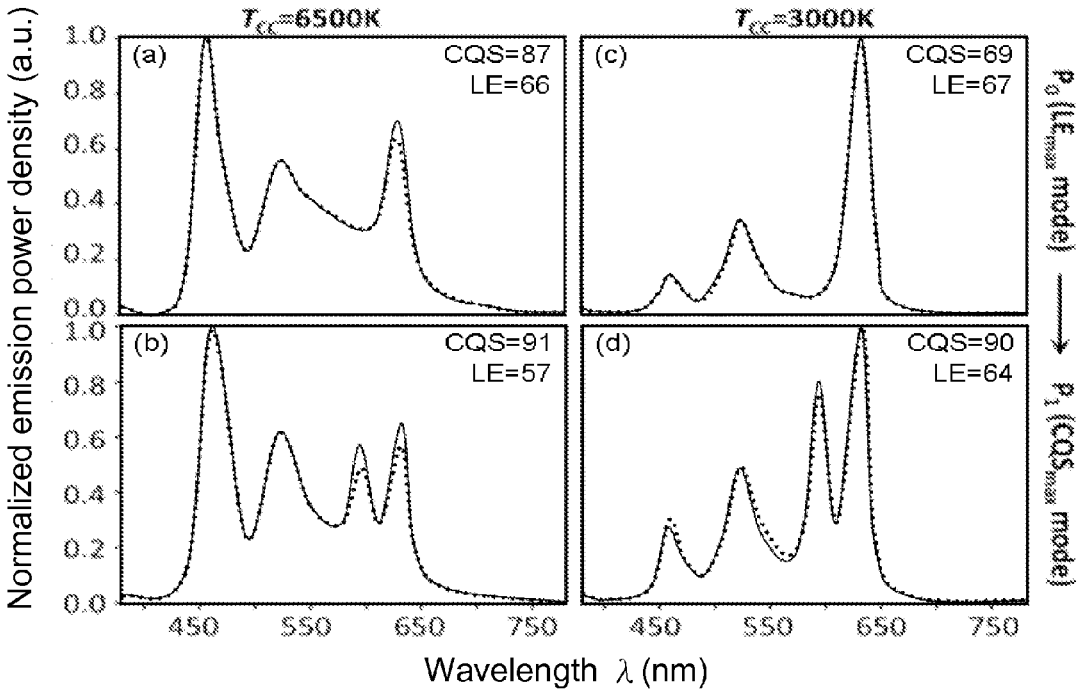
Figure 3(b) Figure 3(d)

METHOD FOR MIXING LIGHT OF LED CLUSTER

BACKGROUND OF THE INVENTION

1. Field of the Invention

The invention discloses a method for mixing light, particularly a methodology for multispectral mixing optimization of LEDs clusters.

2. Description of the Prior Art

The progress in Light-emitting diodes (LEDs) technology has been breathtaking during the last few decades. At this time, great technological advances in LEDs are profoundly changing the way light was generated. In contrast to many conventional light sources, LEDs not only have the potential of converting electricity to light with near-unit efficiency, but also offer impressive controllability of their spatial distribution, temporal modulation, and polarization property. With an arrangement of multispectral LEDs, the LEDs cluster could particularly have the capability of manipulating its synthesized spectral power distributions (SPDs). Such intelligent light sources could be adjusted according to different operational environments and requirements. As a result, tremendous properties of LEDs or LEDs cluster lead to great benefits across a wide field of applications, including lighting, transportation, communication, imaging, agriculture, and medicine.

In general, the mixing of multiple spectra based on LEDs can be accomplished by using (i) additive mixing of two or more single-color LED chips (LED-primary-based approach), (ii) wavelength-conversion via using phosphors or other materials (LED-plus-phosphor-based approach), and (iii) a hybrid approach composed of (i) and (ii). It is well known that a basic trichromatic mixing by LED-primary-based approach is mathematically critical determined, in which the three emission sources are predetermined. In fact, the selections of emission band $\hat{\lambda}$ provide additional degrees of freedom, whose values will be highly relevant to the operational purposes. For example, a trichromatic combination of $\hat{\lambda}$=450-455 nm (spectral width $\Delta\lambda$=5 kT), $\hat{\lambda}_2$=525-535 nm ($\Delta\lambda$=5 kT), and $\hat{\lambda}_2$=600-615 nm ($\Delta\lambda$=5 kT) is very favorable in terms of high color rendering lighting, resulting in a high CRI value in the range of 80-85.

It is generalized that the condition by considering a synthesized SPD composed of n undetermined emission bands, used for certain purpose with specific chromaticity point. The problem is no longer critically determined but underdetermined, which is equivalent to subjecting the 2n-dimensional parameter space $\{\hat{\lambda}_1, \ldots, \hat{\lambda}_n, I_1, \ldots, I_n\}$, composed of emission bands $\hat{\lambda}$ and drive currents I, to three color-mixing constrains. In other words, an optimization happens in searching the best location, composed by two n-dimensional vectors $\{\hat{\lambda}_1, \ldots, \hat{\lambda}_n\}$ and $\{I_1, \ldots, I_n\}$, on the hypersurface with dimensionality 2n−3. Where the best location represents that composed spectrum provides the maximal benefit to the purposes. It could mathematically write the solution in a form as:

$$\arg\max[\{MF, cons\}\{\hat{\lambda}_1, \ldots, \hat{\lambda}_n, I_1, \ldots, I_n\}]$$

where MF is the merit function of the purposes. The term cons indicates three mixing constrains. In 2002, A. Žukauskasa et al. solved the above problem for general lighting applications. For simplicity, each emission band was assumed as a single Gaussian line with $\Delta\lambda$=6 kT. The optimal LEDs clusters for n=2, 3, 4, and 5 were analyzed. Those results address the fundamental tradeoff between the luminous efficacy of radiance LER and the color rendering index CRI, which has the potential to provide a useful guide in the design of a polychromatic system.

However, as the trend of higher efficiencies in phosphor-converted white LEDs continues, the possible hybrid designs increases as well. State of the art tetrachromatic hybrid design (neutral-white/red/green/blue), proposed by G. He et al., can realize a white composite light with high color rendering property as well as high luminous efficiency, but due to the assumption of constant thermal environment (i.e. only consider the dependence of current on source model) a widespread diffusion of multichip LED cluster is not provided. To date, a general SPD synthesizing for practical LED clusters, especially for those with the number of sources >3, is still subject of discussion. Main obstacle lies in the present lack of complete methodology, which can systematically and efficiently optimize SPD for an underdetermined system in consideration of current and temperature dependences In order to overcome current implementation barriers of LEDs cluster, we make an attempt to borrow design techniques from a conventional lens system to develop a general mixing approach in a more complete treatment. The idea arose from the recognition of the fundamental similarity of multi-chip LEDs system and conventional lens system. The whole design flow in all aspects can be closely analogous to a lens design process that has long been developed, by which the spectrum of an LED cluster can be optimized by going through every step of the proposed scheme.

SUMMARY OF THE INVENTION

The main purpose of the invention is to provide a method for mixing light of LED cluster, which can be used in the white lighting emitting diode field.

The adjustable LED of the invention mixes more than two kinds of LED light sources to obtain emitted light with high color rendering index or high luminous efficiency.

The invention provides a genetic algorithm and uses the established multiple LED spectrum database to create a mixing light mode achieving color temperature condition, in order to obtain the global maximum of database, so as to control the LED cluster system.

The adjustable LED light source of the invention is able to be introduced into the modulation of common lighting and light environment. The applied field of the invention is able to comprise the LED field, the fluorescence light source field (such as LED cluster, fluorescence light source array, and fluorescence lamp array), and the other light source field etc.

Therefore, the advantage and spirit of the invention can be understood further by the following detail description of invention and attached figures.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 3(*a*), FIG. 3(*b*), FIG. 3(*c*) and FIG. 3(*d*) show the verification result for the embodiment of the invention.

DESCRIPTION OF THE PREFERRED EMBODIMENT

The invention relates to a method for mixing light of LED cluster, which is able to optimize the LED cluster to obtain the best luminance efficacy of radiation (LER), color rendering index (CRI), or color quality scale (CQS). The LED with multiple wave bands is combined to form the spectrum with objective color temperature. Evaluate the color quality scale (CQS) of color rendering property and the luminance efficacy of radiation and use the continuous genetic algorithm to optimize the most suitable combination ratio for the intensity of LED, adjust the spectrum of objective color temperature and possess the best evaluation index and luminance efficacy of radiation for assess the color rendering property of light source.

The design principle of the invention regards the LED cluster as a lens. Various specific conditions of the LED cluster are considered as important parameters for the design of lens. For example, when the LED with single color space considered as a lens unit, its corresponding relation is defined as:

The LED power determined by its curvature and refractive index can be conceptually analogous to the emitting luminous flux of LEDs determined by the driven current and luminous efficiency, respectively As mixing a number of LEDs, the additive mixing by the dichromatic LED-primary based approach is equivalent to two singlet lenses. Likewise, the LED-plus-phosphor based approach can be regarded as a cemented doublet (dichromatic) or triplet (trichromatic), dependent on the number of exciting peak wavelength.

Figure 1:
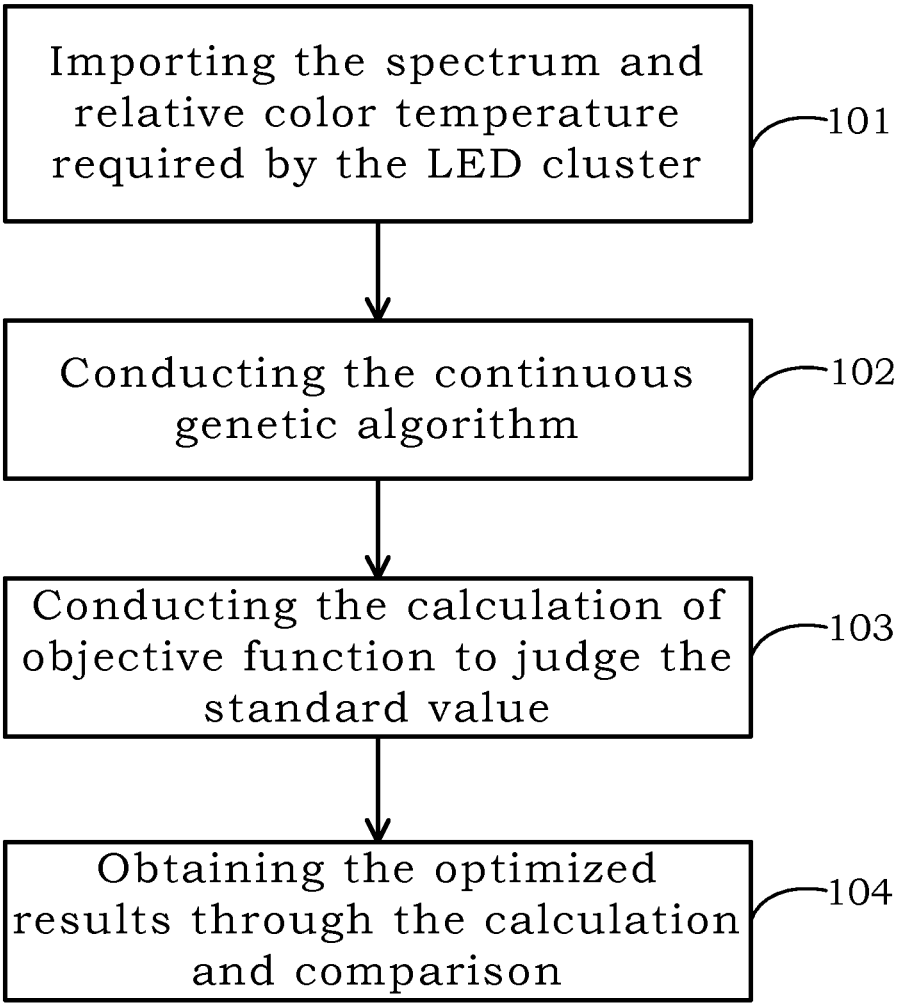
FIG. 1 is a flow diagram illustrating the first preferred embodiment of the invention.

The invention relates to a method for mixing light of LED cluster, which is shown in the first preferred embodiment in FIG. 1. According to the required color temperature and the spectral power distribution (SPD) of different LED, the spectrum of LED is adjusted to form the spectrum for the mixing light of LED, in order to achieve the color coordinate of objective color temperature.

After the spectrum for the mixing light of the color coordinate is achieved, the calculation is conducted in accordance with the following merit function (1):

$$f=w\times CQS+(1-w)\times LE,$$

$$\text{subject to the constrain: weight } w\in[0,1], \quad (1)$$

In the merit function (1), w represents the weight ratio, CQS represents the color rendering index (saturation level of color), and LE represents the luminance efficacy (lm/W).

It can be solved to obtain the values of color quality scale (CQS) and the luminous efficiency (LE) for every set of mixing light, and the best solution of color rendering index and luminous efficiency.

Referring to Step 101 of FIG. 1, firstly, a plurality of LED cluster are provided, and then the step is importing the specific data of LED cluster, including the spectrum of LED cluster, required absolute or relative color temperature.

Referring to Step 102 of FIG. 1, the calculation of continuous genetic algorithm is conducted.

Referring to Step 103 of FIG. 1, the calculation of merit function is conducted to judge the standard value, including maximum color rendering index (CRI or CQS), maximum luminous efficiency and so on, in order to obtain the related information.

Referring to Step 104 of FIG. 1, after the above-mentioned optimal calculation, the optimized results are obtained, including the weight ratio, the optimized color quality scale (CQS), luminous efficiency (LE), and spectral power distribution of LED cluster.

The core mechanism of the invention is the continuous genetic algorithm (CGA). Its concept is to imitate the natural evolution for the calculation. The calculation mechanism mainly includes: reformation, mutation, and selection. The genetic algorithm uses random points searching to obtain the solution, thus the awkward situation of only local maximum will be avoided. The genetic algorithm mainly encodes the parameters into the data structure suitable for the calculation of genetic algorithm. Thus it will not be restricted by the continuity of parameter in searching analysis. Thus it can be applied to different optimization problems. The initial value of genetic algorithm depends on the problem. The random selection of genetic algorithm can obtain diversified initial value in the group, thus the random and global solution can be obtained for the merit function. Compared to other algorithms, the genetic algorithm can get the global maximum through the effective continuous evaluation of variance amount to avoid rapid convergence and constraint.

Figure 2:
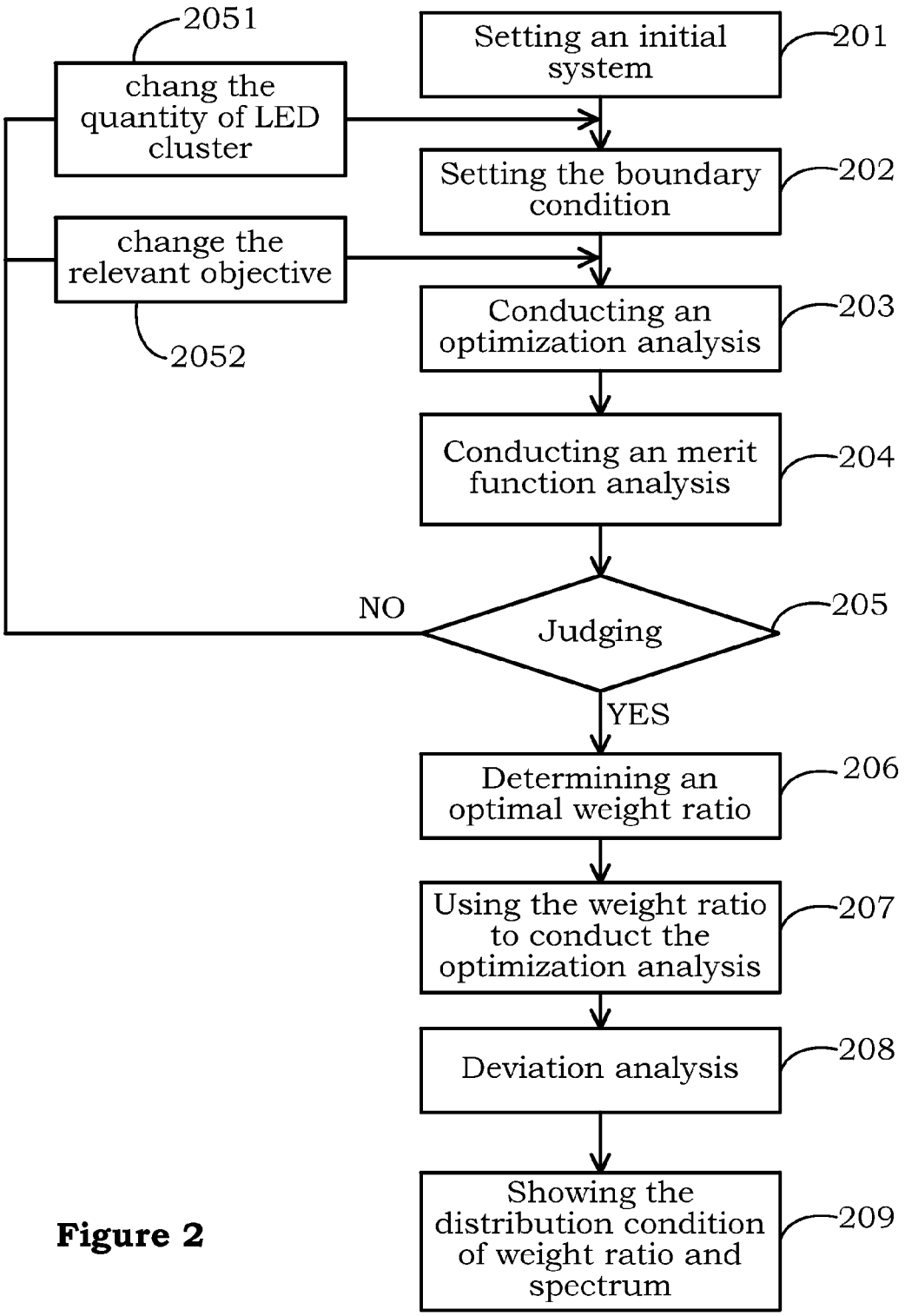
FIG. 2 is a flow diagram illustrating the second preferred embodiment of the invention.

As shown in FIG. 2, a second preferred embodiment of the invention is illustrated. Firstly, an initial system is set in Step 201, wherein the spectrum characteristics and luminous efficiency of every LED are provided. The spectrum characteristics and luminous efficiency can be obtained from the manufacturers or measurement. Generally speaking, a lot of famous LED manufacturers can provide the LED with wide range of wave band. If LED cluster system is mainly defined for high efficiency, the green wave band (505 nm) and the amber wave band (595 nm) will be able to provide better luminous efficiency due to the characteristics of luminous efficacy curve. The simple mixing light mechanism is able to use the color temperature of LED, the category of LED and the spectral power distribution of LED for conducting the adjustment. Normally, in order to select the combination way of LED systematically, the following three ways are employed:

Collecting the default values: Obtaining better initial condition through previous accumulated experience; Collecting the literature: Referring to the published research and literature to obtain better setup value; and collecting the published patents: Referring to the published patents to obtain better setup value.

As shown in Step 201 of FIG. 2, a plurality of LED cluster are provided, then the step is importing the specific data of LED cluster and setting an initial system. For example, the LED with triple monochrome color spaces (630 nm, 530 nm and 450 nm) are used to form the mixing light system, in order to raise the saturation level of color. Because the phosphor based LED has several peak wave bands, it is able to get better mixing light performance compared to the LED with monochrome color space, so as to increase the diversity of mixing light.

As shown in Step 202 of FIG. 2, the boundary conditions are set, including the driven current (I) and the operation ambient temperature ($T_a$): When the optimization of initial system is conducted, the range of parameter should be set in accordance with the range of input, and the rational value should also be set to reduce the calculation time. Normally, the main parameters determining the characteristics for the spectral power distribution of LED are: The driven current (I) and the operation ambient temperature ($T_a$), which mainly determine the peak wavelength ($\lambda_0$), full-width at half-maximum ($\Delta\lambda$) and luminous flux ($\Phi$). The change of the above-mentioned optical characteristics will be different due to the response difference of human eyes on color and the luminance of background.

As shown in Step 202 of FIG. 2 again, if the relation between tristimulus values responded by human eyes and the driven current, the allowable tolerance of three stimulus values obtained from actual mixing light can be defined as the following mathematical equation (2):

$$\|(x, y) - (x_T, y_T)\| < 0.01, \quad (2)$$

where $$x = \frac{X}{X+Y+Z} \text{ and } y = \frac{Y}{X+Y+Z}$$

Where X, Y, Z in equation (2) represent tristimulus values specified in the International Commission on Illumination (CIE) system. The error defined in the mathematical equation (2) is 0.01 color unit, because the human eyes are relatively tardy to the vision response of high illumination.

Still as shown in Step 202 of FIG. 2, when a plurality of LED cluster possesses more than 3 (M=3) color spaces, it will be able to draw a color space limited by the LED cluster in the CIE color coordinate. The color space represents the color point produced by said LED cluster.

As shown in Step 203 of FIG. 2, the optimization analysis is conducted. As the above-mentioned description, it is able to further conduct the calculation of color rendering index and luminous efficiency in a LED cluster with M>3, so that the optimal luminous efficiency and the highest color rendering index can be calculated quickly through genetic algorithm for the light source system with more than 4 LED cluster. The invention is able to consider the assessment of human eyes on the preference of light source effectively. The spectrum synthesized by the mixing light of LED can achieve the color coordinate of objective color temperature by using the set color temperature and the spectral power distribution ratio of LED at different waveband. According to the color rendering property analysis of light source, obtain the color quality scale and luminous efficiency of every set. The best solutions of color quality scale and luminous efficiency are calculated through the algorithm. The value function between both can be defined as the above-mentioned merit function (1).

As shown in Step 201 of FIG. 2 again, the created database of spectral power distribution is used for conducting the optimization analysis. The spectral power distribution generated by different driven current is used as the input value of algorithm. The optimal driven current of every LED is obtained through the algorithm, in order to achieve the default mixing light goal.

As shown in Step 204 of FIG. 2, the optimization analysis is conducted: obtain the solution through the spectral power distribution and the merit function (1), where the weight ratio w can be used to adjust the convergence range quickly by the user.

As shown in Step 201 of FIG. 2 again, when w=0, it means the determining optimization process is the luminous efficiency. On the contrary, When w=1, it means the determining optimization process is the color quality scale. In the calculation process, when M>3 and w=0, there are many combinations of driven current, which can achieve the same default color temperature and objective condition, but only one solution can get the highest luminous efficiency. It is called the global maximum. Under the same condition, when w=1, there is also only one global maximum for obtaining the highest color quality scale.

As shown in Step 205 of FIG. 2, the judgment and optimization are conducted.

As shown in Step 2051 of FIG. 2, if the result of judgment is "No", change the quantity (M) of LED cluster.

As shown in Step 2052 of FIG. 2, if the result of judgment is "No", change the relevant objective values for the luminous characteristics of LED cluster.

As shown in Step 206 of FIG. 2, if the result of judgment is "Yes", determine an optimal weight ratio.

As shown in Step 207 of FIG. 2, use the above-mentioned weight ratio to conduct the optimization analysis. That is to use any LED cluster to reduce the spectral power distribution of single LED with high output by substituting with more than two main the spectral power distribution diagrams, in order to increase the mixing light of LED and increase the arrangement of LED cluster achieving the merit function and optimization.

As shown in Step 208 of FIG. 2, conduct the deviation analysis. Because there is difference in the manufacturing and package of LED, there is difference for the peak wavelength ($\lambda_0$), full-width at half-maximum ($\Delta\lambda$), luminous flux ($\Phi$), spectral power distribution (SPD), driven current ($I_d$), and voltage ($V_f$). Thus in order to avoid the color difference and variance generated by actual mixing light, the feasible compensation mechanism is to measure the spectral power distribution on LED surface and feedback the driven current continuously, conduct the monitoring and correcting, in order to reduce the deviation for the optical characteristics of LED cluster.

As shown in Step 209 of FIG. 2, the optimization result is disclosed, which means the optimal weight ratio and the spectral power distribution are shown after the above-mentioned optimization calculation.

As shown in FIG. 3(*a*), FIG. 3(*b*), FIG. 3(*c*) and FIG. 3(*d*), the verification result for the embodiment of the invention is disclosed, which means the mixing light verification is conducted after the light source array composed by multiple LED is provided. The spectrum for the above-mentioned platform of LED cluster is:

Blue spectrum=470 nm,
green spectrum=525 nm,
amber spectrum=589 nm, and
red spectrum=630 nm.

Through the pulse width modulation (PWM) for a phosphor based cool white LED (Philips TX-213), every LED is able to produce 128 levels of gray-level variation, and accord with the linear superposition and addition of color modulation. Thus from FIG. 3(*a*), FIG. 3(*b*), FIG. 3(*c*) and FIG. 3(*d*), it is known that the applied field for the color temperature of the invention can satisfy 3000K to 6500K of relative color temperature ($T_{CC}$), and can expand to 2600K<relative color temperature ($T_{CC}$)<8500K, in order to meet the requirement of high color rendering index and high luminous efficiency.

In addition, except the above-mentioned constant light source array, the applied field of the invention is able to comprise the fluorescence light source field, such as LED cluster, fluorescence light source array, and fluorescence lamp array, as well as the other light source field etc. . . .

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method for mixing light of constant light source array, wherein the constant light source array is selected from the group consisting of LED cluster, fluorescence light source array, and fluorescence lamp array, comprising:

providing a plurality of constant light source array and importing a specific data of the plurality of constant light source array, wherein importing the specific data of constant light source array comprises importing a spectrum and a color temperature of the constant light source array;

using a continuous genetic algorithm to conduct a calculation, wherein the continuous genetic algorithm encodes a plurality of parameters into a data structure suitable for the calculation of the continuous genetic algorithm;

conducting a merit function, wherein the conducting merit function comprises conducting to judge a standard value including judging a maximum color rendering index and a maximum luminous efficiency, and considering an optimal solution of the color rendering index and the luminous efficiency, comprising:

$$f = w \times CQS + (1 - w) \times LE,$$

subject to the constrain: weight $w \in [0,1]$, w represents the weight ratio, CQS represents the color rendering index (saturation level of color), and LE represents the luminance efficacy (lm/W); and showing an optimization result in order to form the method for mixing light of constant light source array, wherein the optimized results comprises a weight ratio, an optimized color quality scale, a luminous efficiency, and a spectral power distribution of the constant light source array.

2. A method for mixing light of constant light source array, wherein the constant light source array is selected from the group consisting of LED cluster, fluorescence light source array, and fluorescence lamp array, comprising:

providing a plurality of constant light source array, and importing a specific data of the constant light source and setting an initial system, wherein the specific data comprises a spectrum and a color temperature of the plurality of constant light source array;

setting a boundary condition, wherein the boundary condition comprises setting a driven current and an operation ambient temperature, comprising:

$$\|(x, y) - (x_T, y_T)\| < 0.01,$$

where $x = \frac{X}{X+Y+Z}$ and $y = \frac{Y}{X+Y+Z}$ where X, Y, Z in equation (2) represent tristimulus values specified in the International Commission on Illumination (CIE) system. The error defined in the mathematical equation (2) is 0.01 color unit, because the human eyes are relatively tardy to the vision response of high illumination;

conducting an optimization analysis, wherein the optimization analysis comprises calculating a best luminous efficiency and a high color rendering index by an continuous genetic algorithm, wherein the continuous genetic algorithm encodes a plurality of parameters into a data structure suitable for the calculation of the continuous genetic algorithm;

conducting a merit function analysis, wherein the merit function analysis comprises obtaining a solution through a spectral power distribution of the constant light source array, comprising:

$$f = w \times CQS + (1 - w) \times LE,$$

subject to the constrain: weight $w \in [0,1]$, w represents the weight ratio, CQS represents the color rendering index (saturation level of color), and LE represents the luminance efficacy (lm/W);

judging an optimization result to form a Yes result or a No result, wherein if a result of judgment is "No", comprises change a category of the constant light source array, wherein if a result of judgment is "No", comprises change a luminous characteristics of the constant light source array;

determining an optimal weight ratio if a result of judgment being Yes;

using the optimal weight ratio to conduct an optimization analysis;

conducting a deviation analysis, wherein the deviation analysis comprises measuring a spectral power distribution on a surface of the constant light source and a feedback of a driven current continuously, conducting a monitoring and a correcting; and showing an optimization result in order to form the method for mixing light of constant light source array, wherein showing the optimized results comprises a weight ratio, an optimized color quality scale, a luminous efficiency, and a spectral power distribution of the constant light source array.

* * * * *